US006044783A

United States Patent [19]

Moniz

[11] Patent Number: 6,044,783

[45] Date of Patent: Apr. 4, 2000

[54] METHOD AND APPARATUS FOR AUTOMATICALLY FINISHING THE END OF A BINDING STRIP

[75] Inventor: Anthony R. Moniz, East Freetown, Mass.

[73] Assignee: Klear-Vu Corporation, Fall River, Mass.

[21] Appl. No.: 09/280,436

[22] Filed: Mar. 29, 1999

[51] Int. Cl.[7] ..... D05B 35/06

[52] U.S. Cl. ..... 112/475.06; 112/470.33; 112/138; 112/147

[58] Field of Search ..... 112/470.33, 137, 112/138, 147, 152, 235, 303, 320, 475.06, 130

[56] References Cited

U.S. PATENT DOCUMENTS

| | | | |
|---|---|---|---|
| 3,112,719 | 12/1963 | Simonetta . | |
| 3,554,148 | 1/1971 | Johnson . | |
| 3,792,672 | 2/1974 | Friedman et al. | 112/104 |
| 3,972,296 | 8/1976 | Marforio . | |
| 4,280,421 | 7/1981 | Price | 112/138 X |
| 4,606,287 | 8/1986 | Papajewski et al. . | |
| 4,688,499 | 8/1987 | Moore et al. . | |
| 4,708,072 | 11/1987 | Frye . | |
| 4,765,172 | 8/1988 | Seese et al. | 112/147 X |
| 4,949,658 | 8/1990 | Kobayashi . | |
| 5,222,989 | 6/1993 | Hyea . | |
| 5,906,169 | 5/1999 | Martelli | 112/137 |

*Primary Examiner*—Peter Nerbun
*Attorney, Agent, or Firm*—James & Franklin, LLP; Robert L. Epstein; Harold James

[57] ABSTRACT

Prior to being introduced into a sewing machine, an elongated binding strip passes through a plow where it is folded lengthwise to create a recess into which the edge of an article to be bound is received. The strip is trimmed by a cutter to a length longer than the edge to be bound. The trailing end portion of the strip is then folded widthwise, around a retractable rod, by a moveable guide and guided into a plow entrance, after the rod is retracted. The trailing end portion overlaps the leading end portion of the strip as it is sewn to the article, such that only the finished end of the strip is visible.

26 Claims, 7 Drawing Sheets

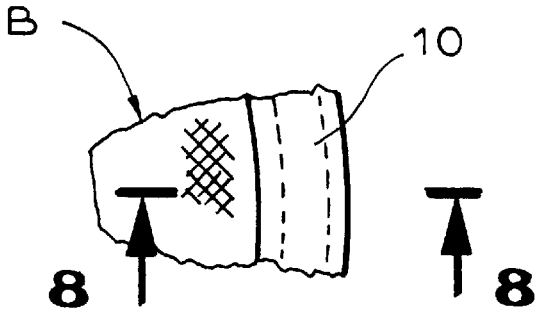
FIG. 7
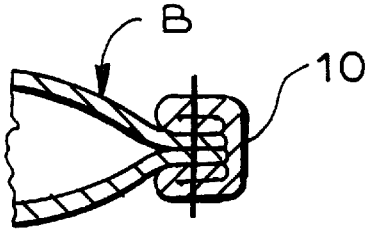
FIG. 8
FIG. 9
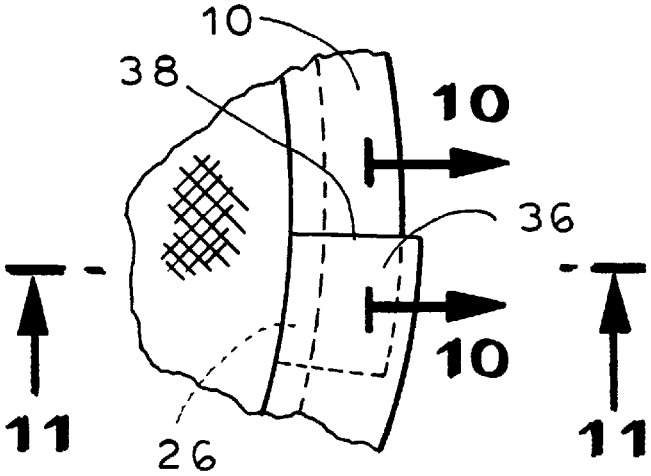
FIG. 10
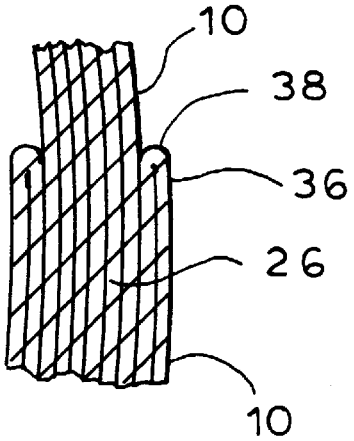
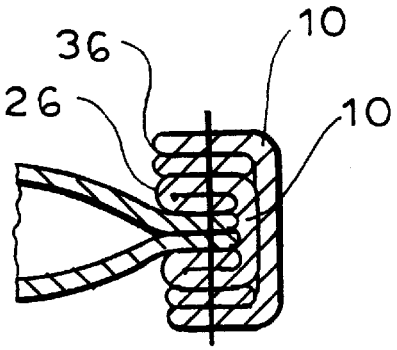
FIG. 11

METHOD AND APPARATUS FOR AUTOMATICALLY FINISHING THE END OF A BINDING STRIP

The present invention relates to a method and apparatus for attaching a binding strip to the edge of an article and more particularly to such a method and apparatus in which the exposed end of the binding strip is automatically finished.

Various textile articles, such as carpeting, bath throw rugs, seat cushions, placemats and the like include an edge where one or more layers terminate and, in some cases, must be sewn together. Since the edge of the layer or layers may be unfinished, uneven and/or unsightly, a strip of material, called a binding strip, is commonly sewn over the of the article edge to cover the raw edge or edges of the layers and, where necessary, to join the edges of the layers together.

The binding strip is an elongated ribbon of material supplied in rolls. It is cut into appropriate length strips by the sewing machine operator, as needed. The cutting results in the ends of the binding strip itself being unfinished. The trailing end portion of the strip may be sewn on the article so as to overlap the leading end portion, thus covering the unfinished leading end. However, the unsightly trailing end of the strip remains exposed.

The trailing end portion of the strip may be manually folded widthwise, over itself, by the operator to hide the raw end and then sewn in place, as it is held by the operator in the folded state. However, to accomplish this requires considerate time and skill, both of which greatly increase the cost of the binding operation.

It is therefore, a prime object of the present invention to provide a method and apparatus for automatically finishing the end of the binding strip.

It is another object of the present invention to substantially reduce the time and labor required to finish the end of a binding strip and to attach the binding strip to the edge of an article.

It is another object of the present invention to provide a method and apparatus for automatically finishing the end of a binding strip which increases the efficiency and reduces the cost of the binding operation.

In general, these objects are achieved by an automatic, pneumatically driven, computer controlled process, in which the trailing end portion of the binding strip is folded widthwise, over itself, to finish the end, as it is fed into the lengthwise folder and sewn to the edge of the article. Since the trailing end portion of the strip is situated over and hides the leading end portion, only the finished end of the strip is exposed.

In accordance with one aspect of the present invention, a method is provided for automatically finishing the exposed end of a binding strip of the type adapted be attached along the edge of an article. A recess is created in the strip to receive the edge of the article. The strip is cut to form the trailing end portion. The trailing end portion is folded over itself. The strip is then attached along the edge of the article with the trailing end portion of the strip overlapping the leading end portion.

The recess is created by folding the strip lengthwise. The strip is folded lengthwise by moving it through a plow. The folded trailing end portion is formed by folding the trailing end portion of the strip widthwise. This is accomplished by holding the strip at a point spaced from the trailing edge with a retractable rod and guiding the strip around the rod and into the plow.

The trailing end portion of the strip is formed by cutting the strip to a length which is longer than the edge of the article to be bound by the strip.

The method further includes the step of moving the strip in the direction in which the strip extends. This is performed by the moving presser foot of a sewing machine. The strip is attached to the article by sewing the strip along the edge of the article.

In accordance with another aspect of the present invention, a method is provided for automatically finishing the end of a binding strip of the type adapted to be attached along the edge of an article. The method includes moving the strip and folding the strip lengthwise as it is moved to create a recess adapted to receive the edge of the article. Starting with the leading end of the strip, the lengthwise folded strip is attached over the edge of the article. The trailing end portion of the strip is formed by cutting the strip to a length longer than the edge of the article to be bound. The trailing end portion of the strip is folded widthwise. The strip is attached to the edge of the article with the trailing end portion of the strip overlaping the leading end portion of the strip.

The strip is attached over the edge of the article by sewing the strip along the edge of the article. It is sewn to the article as the strip is moved by the presser foot of the sewing machine.

The step of folding the strip lengthwise is performed by moving the strip through a plow. The step of folding the trailing end portion of the strip widthwise includes the steps of positioning a retractable rod at a point spaced from the trailing edge, guiding the trailing edge portion of the strip around the rod and into the plow and then retracting the rod. The step of guiding the trailing edge portion of the strip includes the step of moving a guide, in the direction of strip movement, in a plane adjacent to but spaced from the retractable rod.

In accordance with another aspect of the present invention, apparatus is provided for automatically finishing the exposed end of a binding strip adapted to be attached along the edge of an article, the apparatus includes means for folding the strip lengthwise and means for cutting the strip to form the trailing end portion of the strip. Means for folding the trailing end portion of the strip widthwise and for guiding the widthwise folded trailing end portion of the strip into the lengthwise folding means are provided. Means are also provided for attaching the strip along the edge of the article, with the trailing end portion of the strip overlapping the leading end portion.

The means for folding the strip lengthwise preferrably comprises a plow. The plow has an entrance.

The cutting means preferably comprises a pneumatically driven knife.

The means for folding the trailing end portion of the strip widthwise comprises a retractable rod and means for moving the rod between first position, adjacent the strip, and a second position, remote from the strip. The rod cooperates with a guide. Means are provided for moving the guide between a first position, proximate the first position of the rod, and a second position, remote from the first position of the rod. The guide, as it moves from its second position toward its first position, causes the trailing end portion of strip to wrap around the rod and enter the plow entrance.

The rod moving means comprises a pneumatic cylinder. The rod moves substantially transversely relative to the strip.

The guide moving means comprises a pneumatic cylinder. The guide moves substantially longitudinally relative to the strip.

The attaching means comprises a sewing machine. The sewing machine includes means for moving the binding strip as the strip is sewn to the edge of the article. The means for moving the binding strip comprises the moving presser foot of the sewing machine.

To these and to such other objects as may hereinafter appear, the present invention relates to a method and apparatus for automatically finishing the end of a binding strip, as described in detail in the following specification and recited on the annexed claims, taken together with the accompanying drawings, wherein the numerals refer to the parts, and in which:

FIG. 7 is a top plan view of a portion of the binding strip as it appears after being sewn on the article;

FIG. 8 is a cross-sectional view taken along line 8—8 of FIG. 7;

FIG. 9 is a top plan view similar to that of FIG. 7 but showing the overlapping section of the binding strip;

FIG. 10 is a cross-sectional view taken along line 10—10 of FIG. 9; and FIG. 11 is a cross-sectional view taken along line 11—11 of FIG. 10.

Figure 1:
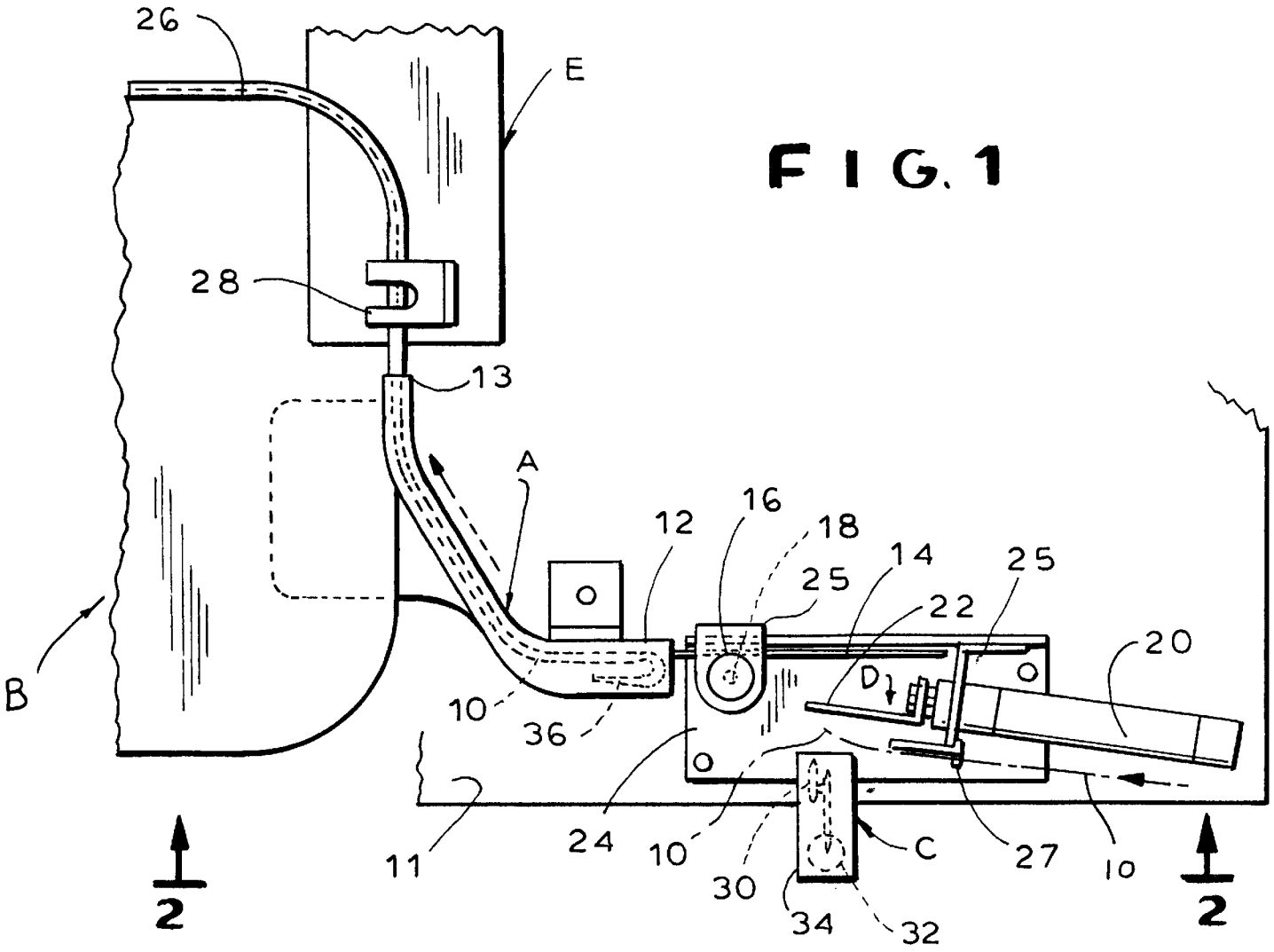
FIG. 1 is a top plan view of the apparatus of the present invention.
Figure 2:
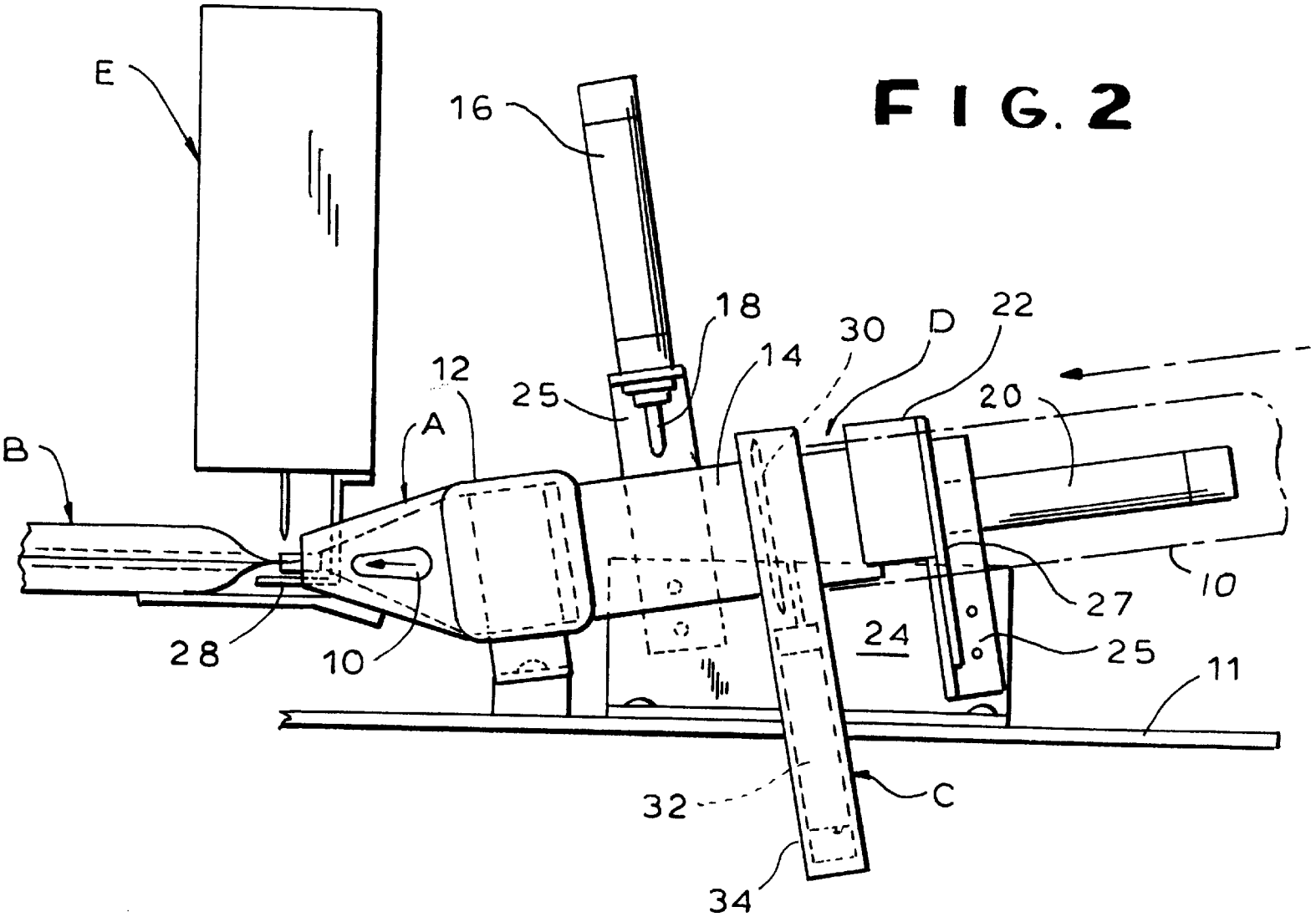
FIG. 2 is a side elevational view of the apparatus of FIG. 1, taken along line 2—2 of the FIG. 1.
Figure 3:
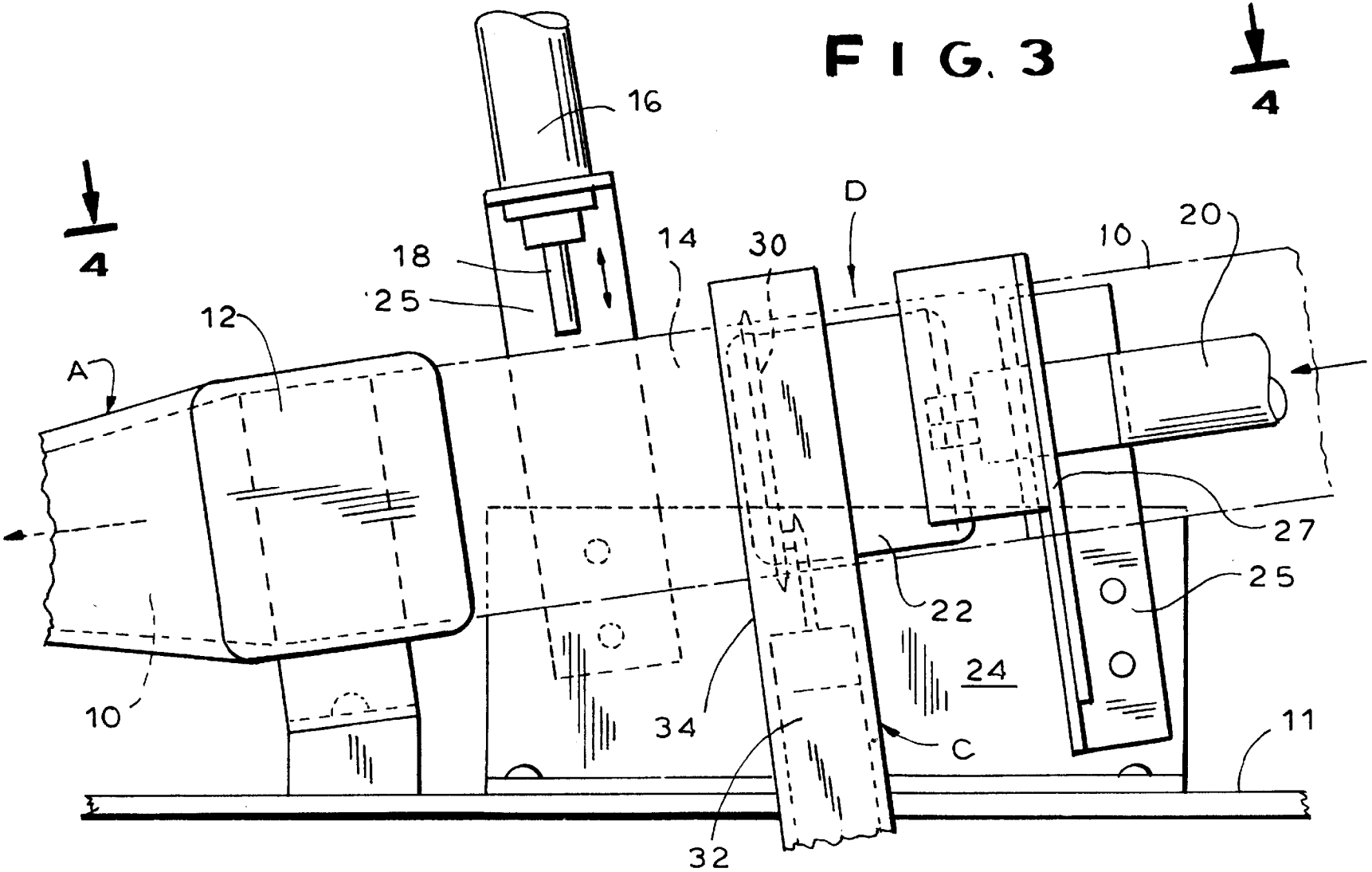
FIG. 3 is an enlarged side elevational view of the plow entrance and widthwise folding mechanism.

As best seen in FIGS. 1 and 2, the apparatus of the present invention comprises a lengthwise folder in the form of a plow, generally designated A, which folds the elongated binding strip 10 lengthwise as it is pulled through the plow to create a "U" shaped recess into which the edge of an article, generally designated B, is received. Means, generally designated C, are provided for automatically trimming strip 10 to a length greater than the length of the edge of article B.

Means, generally designated D, are provided for folding the trailing end portion of strip 10 widthwise, over itself, and guiding it into plow A. The strip is moved through the apparatus by the presser foot of a sewing machine, generally designated E, which attaches strip 10 along the edge of article B with the trailing end portion overlapping the leading end portion.

The apparatus is mounted on a surface 11, such as a table top. Plow A is a funnel-like metal part with "U" shaped cross-sectional configuration of gradually decreasing size from entrance 12 to exit 13. Exit 13 of plow A is proximate the presser foot of the sewing machine. As strip 10 is pulled through plow A, it is folded lengthwise, that is, along a line extending along the length of the strip, which is also the direction of strip movement, so as to form a recess adapted to receive the edge of article B. Preferably, plow A also serves to tuck the top and bottom edges of strip 10 over themselves to hide these edges. When the strip is sewn in place, as seen in FIG. 8, the strip wraps around the edge of article B with the top and bottom edges neatly tucked under and hidden from view.

The entrance 12 of plow A is provided with a stationary part 14 which extends outwardly adjacent widthwise folding means D and acts to funnel strip 10 into plow A. Folding means D includes a substantially vertically oriented, pneumatically driven cylinder 16 with a retractable rod 18 and a substantially horizontally oriented, pneumatically driven cylinder 20 with a planar guide 22 mounted on its piston rod 23. Cylinders 16 and 22 are mounted on surface 11 by a horizontal bracket 24 and vertical brackets 25.

The process begins with the operator gripping the leading end portion 26 of strip 10, supplied on a supply roll (not shown), passing it through an upstanding guide bracket 27, between plow funnel 14 and rod 18, which is in its extended (down) position and feeding it through plow A until it is aligned with the moving presser foot 28 of sewing machine E. The sewing machine is actuated, pulling strip 10 through the apparatus and causing the strip, folded lengthwise by plow A to form a "U" shaped recess, to be stitched to the edge of article B, shown here as a seat cushion, for example.

Figure 4:
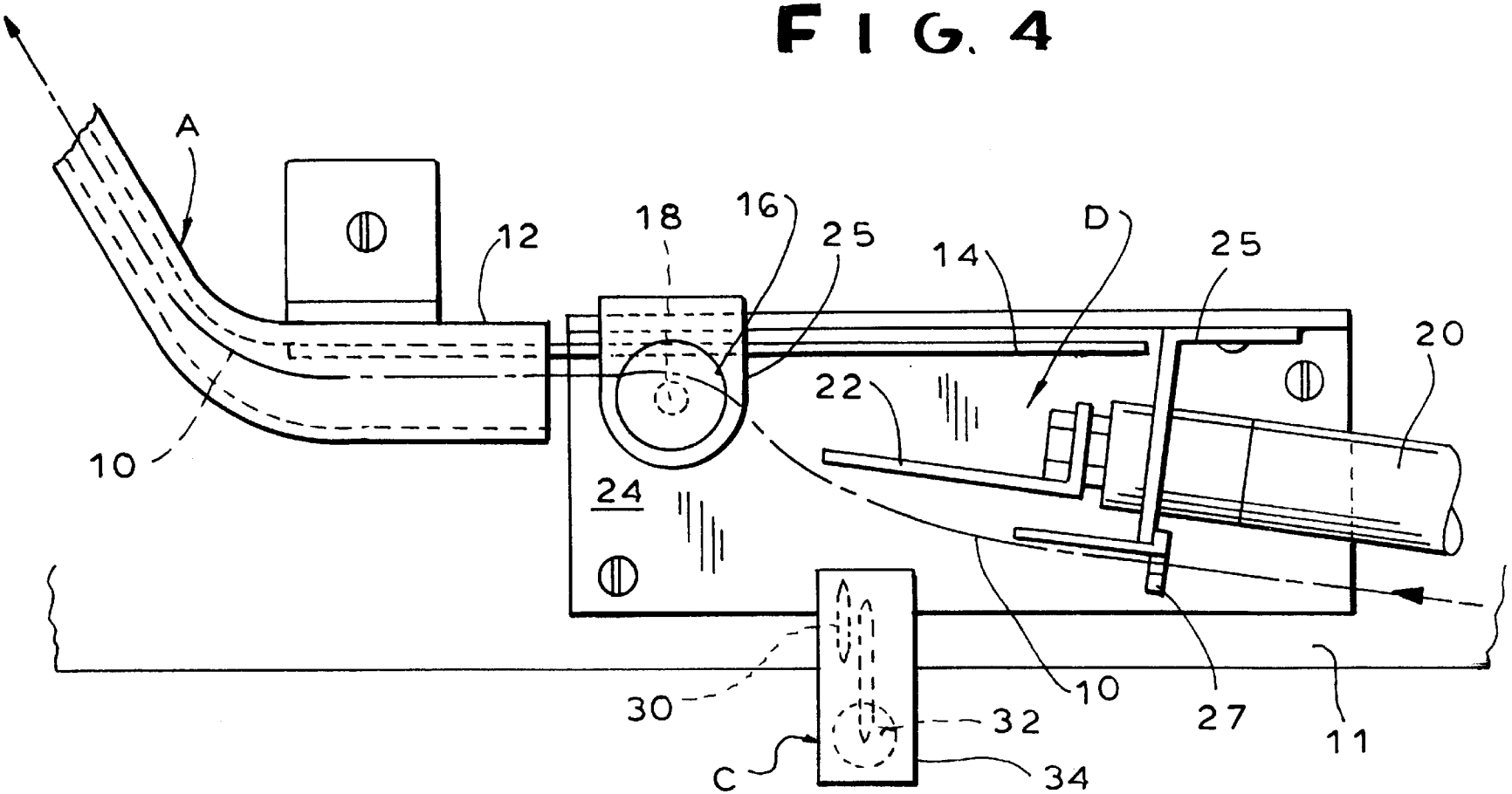
FIG. 4–6 are views similar to FIG. 1 illustrating the sequence of part movements in the trimming and widthwise folding operations.
Figure 5:
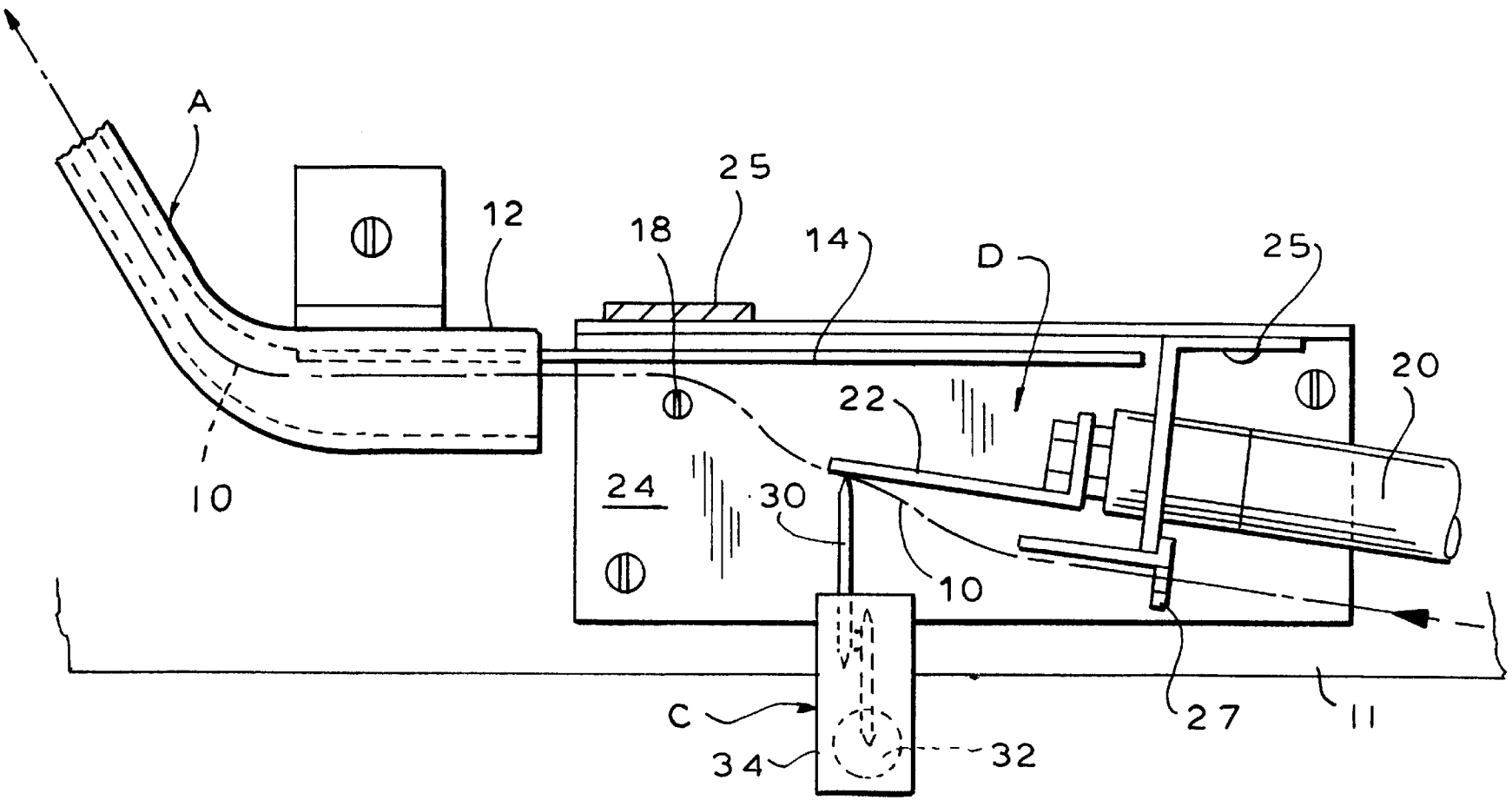

After strip 10 has been sewn along a substantial portion, but not all, of the edge of article B, it appears as shown in FIGS. 4, 7 and 8. The blade 30 of substantially vertically oriented trimmer C is driven by a pneumatic cylinder 32 to trim strip 10 to a length which is greater than the length of the edge of article B (see FIG. 5). Trimmer C is enclosed in a transparent plastic case 34 for safety reasons. In this way, the trailing end 36 of the strip 10 is formed. Preferrably, strip 10 is cut to a length about an inch longer than the length of the edge of article B.

Figure 6:
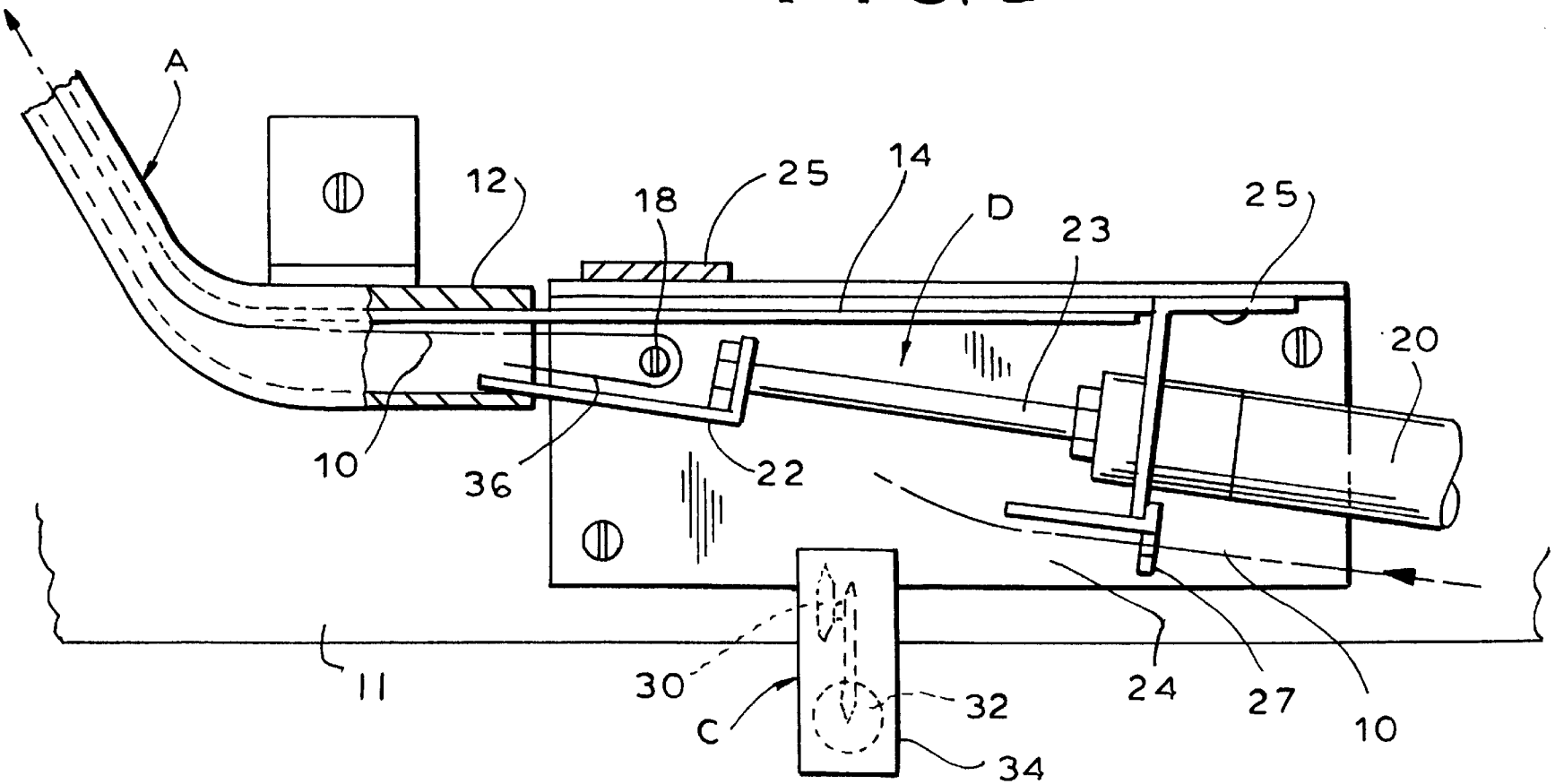

Immediately after strip 10 is cut, pneumatic cylinder 20 is actuated to extend rod 23 and thus move guide 22 toward and into plow entrance 12 (see FIG. 6). Guide 22 moves in a plane which forms an acute angle with funnel 14, which plane is adjacent to rod 18 in its extended (down) position. Guide 22 moves in this plane between its retracted position, remote from rod 18 (FIGS. 4, 5) and an extended position (FIG. 6), adjacent rod 18. As guide 22 moves from its retracted position to its extended position, it engages the previously cut trailing end portion 36 of strip 10, wraps it around rod 18, which is in its extended position, to fold end portion 36 widthwise, over itself, and then guide the widthwise folded end portion 36 into entrance 12 of plow A.

Cylinder 16 is then caused to retract rod 18. Guide 22 remains in its extended position, holding the widthwise folded trailing end portion 36 within entrance 12 of plow A as trailing end portion 36 of strip 10 is pulled through the plow A. Then guide 22 is retracted, see FIG. 1.

Strip 10 is pulled through the plow as it continues to be sewn to the edge of the article. As seen in FIGS. 9–11, the widthwise folded trailing end portion 36 of strip 10 is sewn in position overlapping leading end portion 26 with only the finished edge 38 of the trailing end 36 portion exposed.

After guide 22 is moved by cylinder 20 to its retracted position and rod 18 is moved back to its extended position, the apparatus is then ready for the operator to grip the leading end portion of the next binding strip, feed it through bracket 27, behind extended rod 18, through plow A and into alignment with presser foot 28. A new article B to be bound is positioned adjacent the sewing machine and the apparatus is actuated to repeat the sequence.

It will now be appreciated that the present invention is a method and apparatus for automatically finishing the exposed end of a binding strip, as the strip is attached to the article. This is accomplished by folding the trailing end portion of the strip widthwise and lengthwise and then sewing it on the article in overlapping relation with the leading end portion of the binding strip.

While only a single preferred embodiment of the present invention has been disclosed for purposes of illustration, it is obvious that many variations and modifications could be made thereto. It is intended to cover all of these variations and modifications which fall within the scope of the present invention, as defined by the following claims:

I claim:

1. A method for automatically finishing an end of a binding strip adapted to be attached along the edge of an article, the method comprising the steps of:

(a) creating a recess in the strip to receive the edge of the article;

(b) cutting the strip to form a trailing end portion;

(c) folding the trailing end portion of the strip over itself; and (d) attaching the strip along the edge of the article, with the trailing end portion of the strip overlapping a leading end portion.

2. The method of claim 1 wherein the step of creating a recess comprises the step of folding the strip lengthwise.

3. The method of claim 1, wherein the step of folding the trailing end portion of the strip over itself comprises the step of folding the trailing end portion of the strip widthwise.

4. The method of claim 1, wherein the step of cutting comprises the step of cutting the strip to a length which is longer than the edge of the article to be bound by the strip.

5. The method of claim 1, further comprising the step of moving the strip in the direction in which the strip extends.

6. The method of claim 5, wherein the step of moving is performed by a moving presser foot of a sewing machine.

7. The method of claim 1, wherein the step of attaching the strip comprises the step of sewing the strip along the edge of the article.

8. The method of claim 2, wherein the step of folding the strip lengthwise comprises the step of moving the strip through a plow.

9. The method of claim 1, wherein the step of folding the trailing end portion comprises the steps of positioning a rod adjacent to the strip and guiding the trailing edge portion of the strip around the rod.

10. A method for automatically finishing a end of a binding strip adapted to be attached along the edge of an article, the method comprising the steps of:

(a) moving the strip;

(b) folding the strip lengthwise as it is moved to create a recess adapted to receive the edge of the article;

(c) forming a trailing end portion of the strip by cutting the strip to a length greater than the edge of the article to be bound;

(d) folding a trailing end portion of the strip widthwise; and (e) attaching the strip over the edge of the article with the trailing end portion of the strip overlapping a leading end portion.

11. The method of claim 10, wherein the step of attaching is performed by sewing the strip to the edge of the article.

12. The method of claim 10, wherein the step of moving the strip is performed by moving a presser foot of a sewing machine.

13. The method of claim 10, wherein the step of folding the strip lengthwise to form a recess is performed by moving the strip through a plow.

14. The method of claim 10, wherein the step of folding the trailing end portion of the strip widthwise comprises the steps of positioning a rod adjacent the strip and guiding the trailing end portion of the strip around the rod.

15. The method of claim 14, wherein the step of guiding the trailing end portion of the strip comprises the step of moving a guide, in the direction of strip movement, in a plane adjacent to the rod.

16. Apparatus for automatically finishing an exposed end of a binding strip, the binding strip being adapted to be attached along the edge of an article, comprising means for folding the strip lengthwise; means for cutting the strip to form a trailing end portion; means for folding the trailing end portion of the strip widthwise; and means for attaching the strip along the edge of the article, with the trailing end portion of the strip overlapping a leading end portion.

17. The apparatus of claim 16 wherein said means for folding the strip lengthwise comprises a plow.

18. The apparatus of claim 16 wherein said cutting means comprises a pneumatically driven blade.

19. The apparatus of claim 17 wherein said means for folding the trailing end portion of the strip widthwise comprises a rod, means for moving said rod between a first position, adjacent the strip, and a second position, remote from the strip, a guide, means for moving said guide between a first position, proximate said first position of said rod, and a second position, remote from said first position of said rod, said guide, as it moves from its second position toward its first position, causing the trailing end portion of the strip to move around said rod and into said plow.

20. The apparatus of claim 19, wherein said rod moving means comprises a pneumatic cylinder.

21. The apparatus of claim 20, wherein said rod moves substantially transversely relative to the strip, as it moves from its second position toward its first position.

22. The apparatus of claim 19, wherein said guide moving means comprises a pneumatic cylinder.

23. The apparatus of claim 19, wherein said guide moves in a direction along the length of the strip, as it moves from its second position toward its first position.

24. The apparatus of claim 16, wherein said attaching means comprises a sewing machine.

25. The apparatus of claim 24, wherein said sewing machine comprises means for moving the strip.

26. The apparatus of claim 25, wherein said means for moving the strip comprises a moving presser foot of the sewing machine.

* * * * *